US007555977B2

(12) United States Patent
Crotty et al.

(10) Patent No.: US 7,555,977 B2
(45) Date of Patent: Jul. 7, 2009

(54) FIRING PIN AND VALVE ASSEMBLY

(75) Inventors: Jeffrey L. Crotty, Coon Rapids, MN (US); John F. Revolinski, Minneapolis, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 135 days.

(21) Appl. No.: 11/510,228

(22) Filed: Aug. 25, 2006

(65) Prior Publication Data

US 2007/0199434 A1 Aug. 30, 2007

Related U.S. Application Data

(60) Provisional application No. 60/719,862, filed on Sep. 23, 2005.

(51) Int. Cl.
*F41F 1/06* (2006.01)
*F41A 9/00* (2006.01)

(52) U.S. Cl. ..... 89/1.35; 89/26; 89/45

(58) Field of Classification Search ..... 89/1.35, 89/1.8, 17, 26, 37.05, 36.01, 36.02, 36.03, 89/36.04, 36.07, 36.08, 36.09, 36.12, 36.17, 89/45, 188, 304.4, 313.3, 314.2, 321.5, 457
See application file for complete search history.

(56) References Cited

U.S. PATENT DOCUMENTS 2,382,225 A * 8/1945 Hochstetler ..... 89/1.35
2,960,977 A * 11/1960 Moorehead, Jr. ..... 124/70
4,207,795 A 6/1980 Reed et al.
5,410,942 A 5/1995 Begneu
6,212,990 B1 4/2001 Elspass
6,450,080 B1 9/2002 Pochard et al.
6,851,348 B1 2/2005 Ang
6,904,901 B2 * 6/2005 Mitchell ..... 124/65
7,458,304 B1 * 12/2008 Bennett et al. ..... 89/1.35
2004/0244572 A1 * 12/2004 Borgwarth et al. ..... 89/17

* cited by examiner

*Primary Examiner*—Bret Hayes
(74) *Attorney, Agent, or Firm*—Patterson, Thuente, Skaar & Christensen, P.A.

(57) ABSTRACT

A gun for firing a round of caseless ammunition, a round of such ammunition having a projectile and a modular propellant, the projectile and a modular propellant being disposable for firing in a gun tube, includes an actuatable valve being selectively openable to the gun tube, the valve for drawing a negative pressure in the gun tube, the negative pressure acting to pull the round into contact with a breech face such that when a firing pin is forceably released, the firing pin reliably strikes a primer of the modular propellant, the primer igniting the modular propellant, the ignited propellant forcefully discharging the projectile from the gun tube. A firing pin and valve assembly and a method of operating a gun are further included.

17 Claims, 16 Drawing Sheets

FIRING PIN AND VALVE ASSEMBLY

CROSS-REFERENCE TO RELATED APPLICATION

This application claims priority under 35 U.S.C. § 119(e) to, and hereby incorporates by reference, U.S. Provisional Application No. 60/719,862, filed Sep. 23, 2005.

TECHNICAL FIELD

The present invention relates to large caliber military-type weapons. More particularly, the present invention relates to such weapons designed for use with rimless ammunition.

BACKGROUND OF THE INVENTION

A conventional round of ammunition typically has a rimmed case supporting a projectile. When the round is inserted into the breech of a gun tube, the rim on the case engages a groove defined in the breech end of the gun tube that ensures that when the breech is closed, the round is correctly positioned relative to a breech face for the primer of the round to be struck by the firing pin during firing of the gun. This positioning is irrespective of the elevation or depression of the gun tube.

Mortars have for years used caseless ammunition, but to ensure that the round is in contact with the breech for firing, the barrel is always angularly elevated. Many types of modern ammunition are caseless, having a separate projectile and modular propellant components. An advantage of such ammunition is that the number of modular propellants may be varied depending upon the range over which the projectile is desired to be fired. A problem with such ammunition is that, without a case, there is no rim to correctly position the round relative to the firing pin when the breech assembly is closed. Without such rim, the modular propellant may be spaced apart from the breech assembly face when the breech assembly is closed, especially if the barrel is only slightly elevated or is angularly depressed. In such disposition, the firing pin may not reach the primer of the modular propellant or may not reach the primer with sufficient force to ignite it, resulting in a dud or misfired round.

There is a need then in the industry to provide a reliable system of ensuring that rimless ammunition is regularly seated against the breech face of the breech assembly prior to filing of the round. There is further a need to provide a simple mechanism by which to control both the firing pin and the valve; speed, timing and control must be easily obtained through a simple rotational or linear movement.

SUMMARY OF THE INVENTION

The firing pin and valve assemblies of the present invention substantially meet the aforementioned needs of the industry. A valve of the valve assembly is opened immediately prior to release of the firing pin. The IBAR (In Barrel Air Regulation) of the present invention supplies a vacuum to draw the caseless round (comprising a projectile and a propellant charge(s) back against the face of the breech. Alternatively, positive pressure may be applied through the open valve to expel a round from the barrel (in cases of misfires or dud rounds). The vacuum and positive pressure is preferably supplied to the barrel through the same valve.

It is critical that the valve must be closed during firing to prevent the high blast pressures from the prolusion charges from escaping rearward where damage or personal injury may be caused. In addition, the firing pin must be activated very soon after the valve is closed because the pressure differential created by the vacuum is soon equalized after the valve is closed and vacuum has ceased. This could permit the round to slide down the barrel away from the seat of the breech causing the firing pin not to fire the round.

Inadvertent firings are also a serious risk, especially when the breech is either open or unsealed. As such, it is critical that the firing pin have an interlock to ensure it cannot be activated from the cocked disposition until a safe condition to fire exists. The mechanism to operate both the valve and the firing pin can be very complex and difficult considering the timing, control and speed at which they must be operated. The present invention meets these critical needs as noted below.

A vacuum is drawn through a valve pulling the modular propellant and projectile (the round) firmly against the breech face such that when the firing pin is released from the cocked disposition it reliably strikes the primer and the projectile is forcefully discharged from the gun tube. Significantly, actuation of both the firing pin and valve is always against an opposing bias, the bias tending to return both the firing pin and the valve to their respective previous disposition for safety. Actuation of the valve and the firing pin is mechanically timed such that the valve is always closed momentarily before the firing pin is released to strike the primer. This ensures that there can be no blow by passed an opened valve when the round is fired.

In a first embodiment, the mechanism is a cam operated concentrically orientated preferably firing pin and valve for use in a gun, called IBAR (In Barrel Air Regulation). Both the firing pin and valve are actuated by their movement along the cam. As the cam is rotated the firing pin and valve ride along respective cam paths and are each axially displaced in opposite directions. Each cam path has a respective "step" which allows the spring loaded firing pin during firing action and the spring loaded valve during closing action to move very rapidly under their respective spring forces. The cam offers the distinct advantage of operating both the valve and firing pin with a single motion of the cam, rotary or linear. In addition, the cam paths can be designed to ensure precise movement and timing of the valve and firing pin by capturing and closely controlling the movements of the valve and firing pin.

The valve is attached to a spring, which keeps the valve closed, much like a car valve. The cam provides the force, which acts against this spring force to articulate it from this closed position. The firing pin is also spring loaded. When the firing pin is drawn up against the spring in the cocked disposition, it compresses the spring. When the firing pin is suddenly released to fire a round of ammunition, the force of the compressed spring acting against the firing pin propels it.

The cam is used to provide the compressive movement of the firing pin against the spring. The firing pin and valve, which are arranged coaxially, operate on individual cam paths on the same cam. This allows the specific timing of the firing pin and valve through the operation of a single cam. Each cam path also has steps which allow the valve to close very quickly and the firing pin to fire quickly. Cam followers (rollers) are attached to valve and firing pin. These rollers ride along the cam path. Rotation of the firing pin and valves must be contained to ensure the rollers ride along the cam path rather than the cam path simply rotating the valve and firing pin. In addition, this restraint ensures good contact between the rollers and cam path. The cam is operated by a rotational movement applied from an external source. Some possibilities include sprockets (belt, chain, etc.) attached to cam, shaft (keyed, splined, friction fit, etc.) attached to shaft, or motor directly connected to cam, to name a few. In addition, the cam can be orientated vertically, or horizontally. The cam can be designed to contain the roller in both directions (extension and compression). This can be helpful to ensure the valve or pin is not "hung-up" and cannot be moved by their respective springs. However, it should be noted that it may be desirable to have some gap between the roller and cam path in one of its directions. This play assures that the valve is seated against the sealing surface instead of bottoming out on the cam.

The present invention is a gun for firing a round of caseless ammunition, a round of such ammunition having a projectile and a modular propellant, the projectile and a modular propellant being disposable for firing in a gun tube, includes an actuatable valve being selectively openable to the gun tube, the valve for drawing a negative pressure in the gun tube, the negative pressure acting to pull the round into contact with a breech face such that when a firing pin is forceably released, the firing pin reliably strikes a primer of the modular propellant, the primer igniting the modular propellant, the ignited propellant forcefully discharging the projectile from the gun tube. The present invention is further a firing pin and valve assembly and a method of operating a gun.

DETAILED DESCRIPTION OF THE DRAWINGS

The firing pin and valve assembly of the present invention is depicted generally at 10 in the figures. The firing pin and valve assembly 10 is designed to be disposed in a breech assembly 12. The breech assembly 12 may be a component of an exemplary gun 120, as depicted in FIG. 1.

Figure 1:
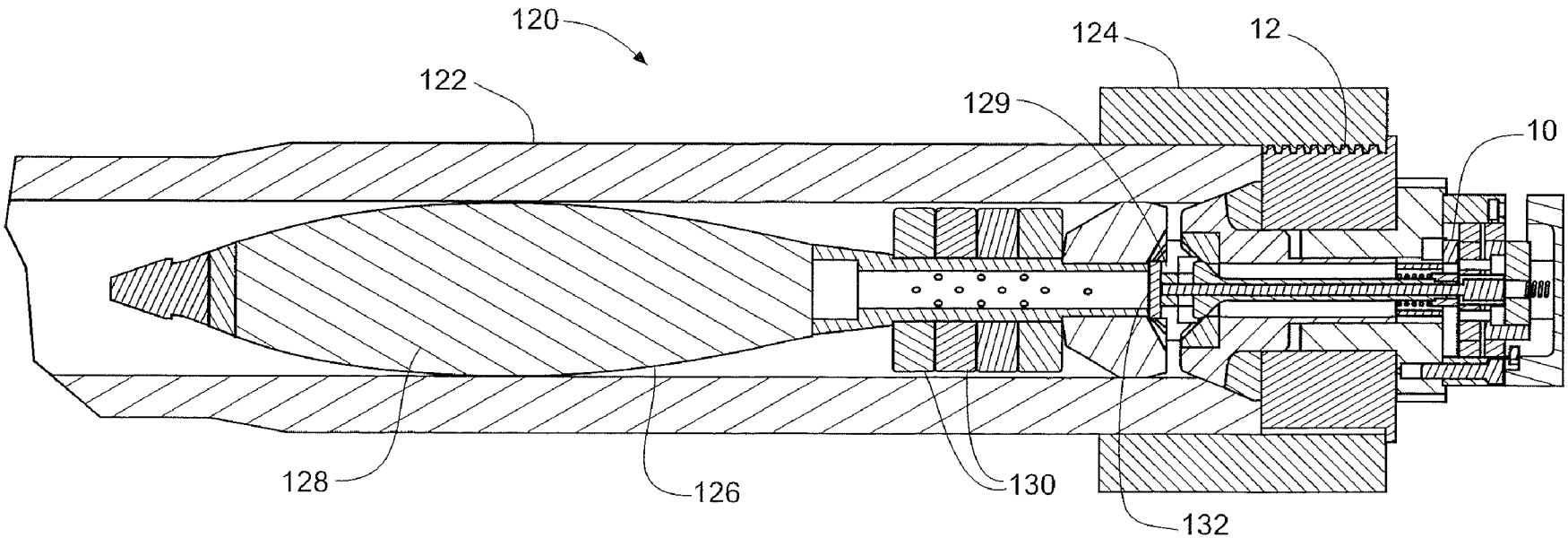
FIG. 1 is a sectional view of the breech area of an exemplary gun employing the firing pin and valve assemblies of the present invention and depicting a rimless round disposed therein.

FIG. 1 depicts the gun 120. In this depiction, the gun 120 is a mortar-type gun. It is understood that the firing pin and valve assembly 10 of the present invention may be used with other types of guns where rimless ammunition is desired to be used.

The gun 120 includes a gun tube or barrel 122. A breech housing 124 is disposed at the end of the gun tube 122 from which ammunition is loaded. The breech housing 124 includes the firing pin and valve assembly 10 of the present invention mounted in the breech assembly 12.

Figure 2:
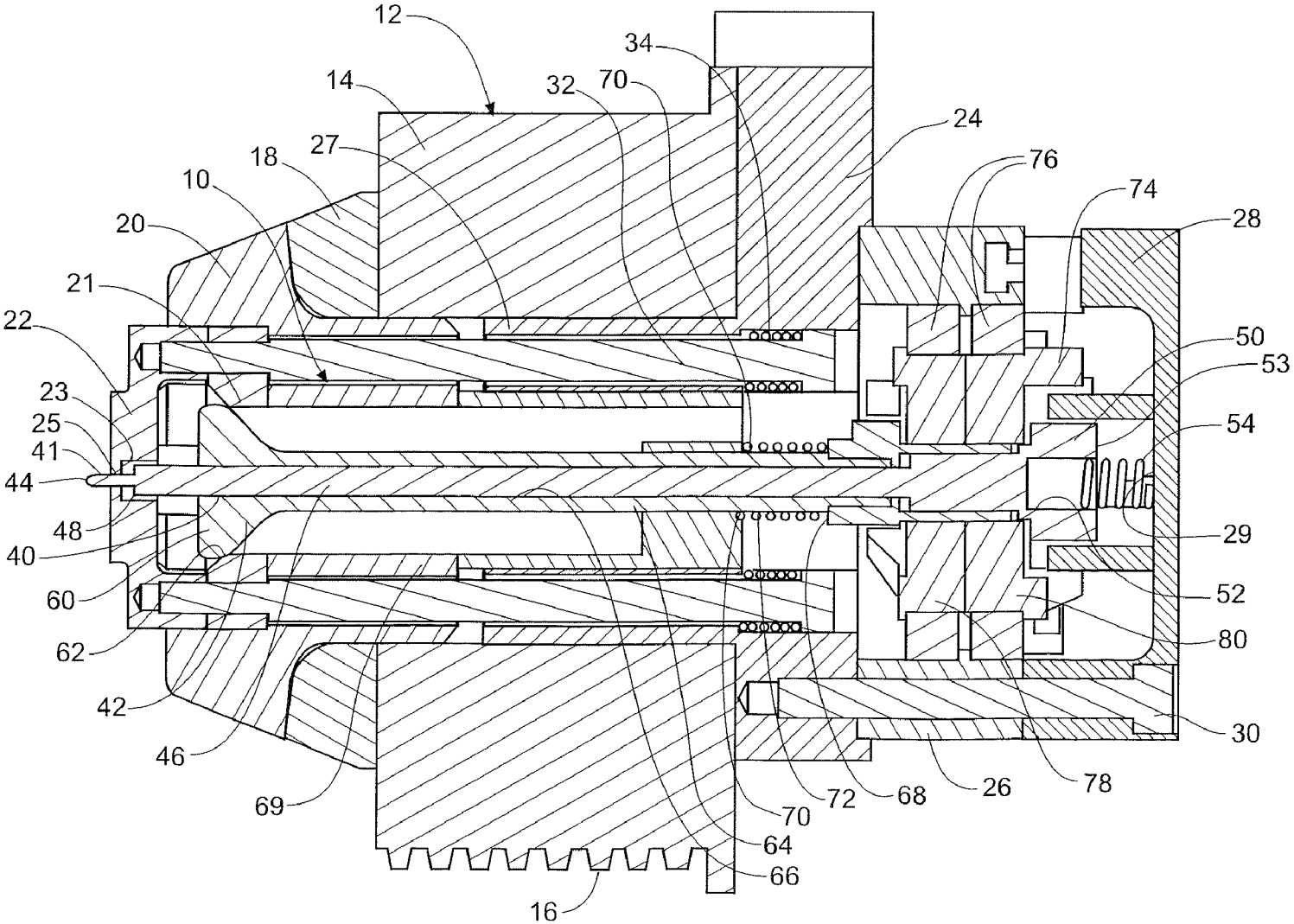
FIG. 2 is a sectional view of a breech assembly and the firing pin and valve assemblies of the present invention.

A rimless round 126 is disposed in the gun tube 122. The rimless round 126 has a projectile 128 and a series of modular propellants 130. It is understood that the number of modular propellants 130 may be varied as desired to effect a greater or lesser firing range. A primer 132 is disposed at the very end of the rimless round 126, seated against the breech face 129 of the breech assembly 12. As depicted in FIG. 2, the breech assembly 12 is designed to be readily removed from the breech housing 124 of the gun 120 for loading of the rimless round 126. Accordingly, the breech assembly 12 has a breech 14 with a plurality of teeth 16 formed thereon for engaging with cooperative teeth defined internal to the breech housing 124. A seal 18 is disposed forward of the breech 14 for effecting a gas tight seal between the breech assembly 12 and the breech housing 124 of the gun 120. A spindle 20 is disposed adjacent to the seal 18. The spindle 20 is held in compressive engagement with both the seal 18 and the breech 14. An interior face of the spindle 20 comprises valve seat 21. A mortar seat 22 is disposed adjacent to the spindle 20. The forward directed face 129 of the mortar seat 22 is the component of the breech assembly 12 against which the rimless round 126 is drawn by vacuum and thereby seated prior to firing. The mortar seat 22 has an interiorly defined face comprising a firing pin stop 23. The firing pin stop 23 has a bore 25 defined therein through which the tip 44 of the firing pin 41 projects to strike the primer 132 of the rimless round 126.

Rearward of the breech 14 is the carrier 24. The carrier 24 is a major structural component and, as such, supports the breech 14 on a forward directed cylindrical support 27.

A bearing housing 26 is disposed rearward of the carrier 24. The bearing housing 26 has an interiorly defined bearing race 31. A cover 28 is disposed rearwardly of the bearing housing 26. The cover 28 has an interiorly defined face that comprises a valve spring seat 29.

It is the carrier 24 that provides the structural integrity with the entire breech assembly 12. Accordingly, bolts 30 capture both the cover 28 and the bearing housing 26, coupling them to the carrier 24. Likewise, spindle bolts 32 extend forward from the carrier 24 and threadedly engage the mortar seat 22. The spindle bolts 32 bear on bolt springs 34 to provide a constant compressive bias to the mortar seat 22 that holds the mortar seat 22, the spindle 20, the seal 18 and the breech 14 in compressive engagement with the carrier 24.

The firing pin and valve assembly 10 of the present invention has three major subcomponents; the firing pin assembly 40, valve assembly 42, and cam assembly 43. The firing pin assembly 40 is first discussed below.

Figure 3:
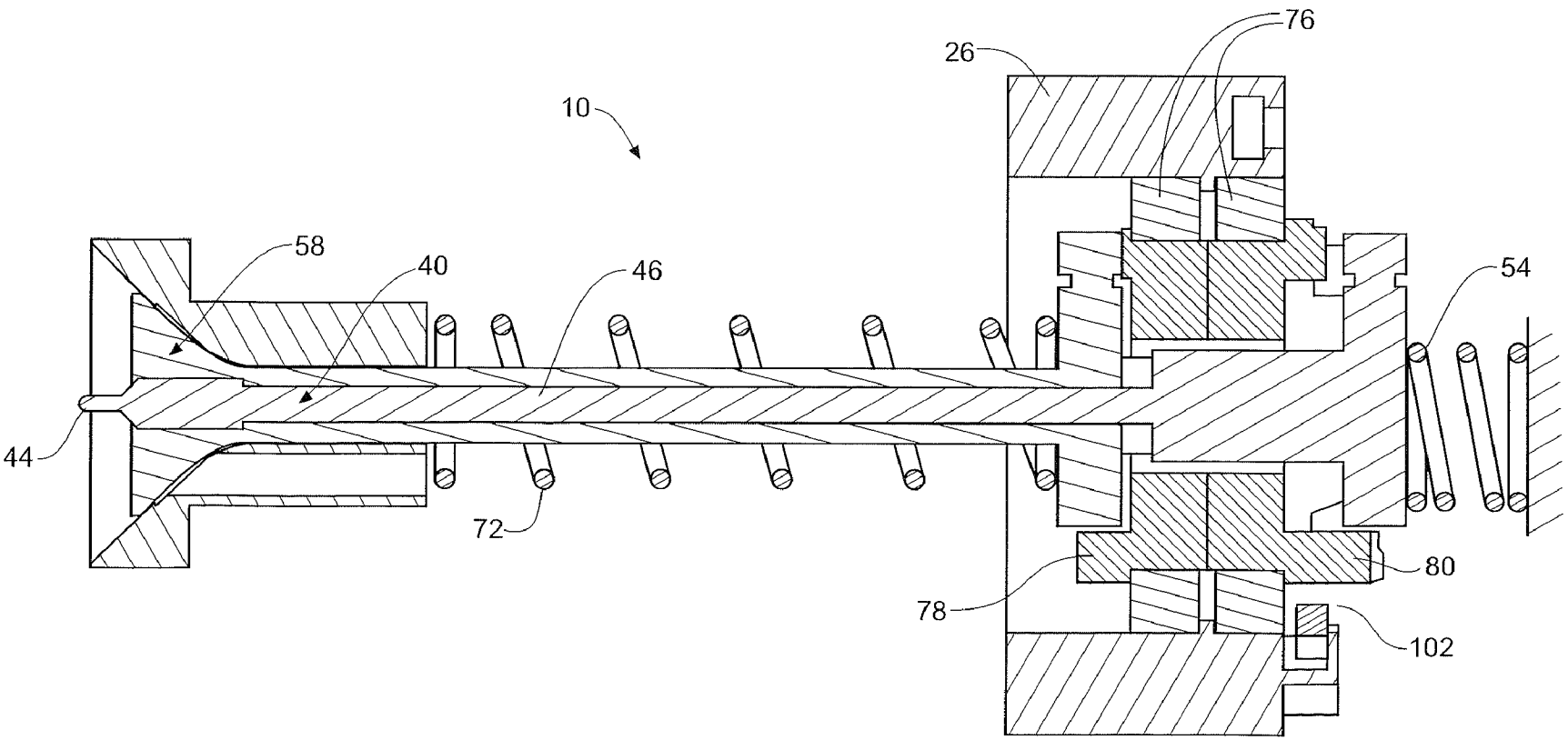
FIG. 3 is a sectional view of the firing pin and valve assemblies of the present invention.

The firing pin assembly 40 is best depicted in FIGS. 2 and 3. The left-most portion of the firing pin 41 is the tip 44. In the fired disposition, the tip 44 projects leftward of the mortar seat 22 in order to strike the primer 132. The tip 44 is a relatively small diameter extension of the elongate shank 46 of the firing pin 41. The tip 44 is joined to the shank 46 at a shoulder 48. The shoulder 48 is disposed transverse to the longitudinal axis of the firing pin 41.

The actuation end 50 of the firing pin 41 is disposed at the opposite end of the firing pin 41 from the tip 44. The actuation end 50 has a generally expanded diameter as compared to the shank 46. A rearward opening blind spring housing 52 is defined in the actuation end 50. The spring housing 52 is open to the rear face 53 of the actuation end 50. A firing pin spring 54 is at least partially disposed in the spring housing 52 and acts to bias the firing pin 40 in the leftward (or firing) direction as depicted in FIGS. 2 and 3.

Figure 5:
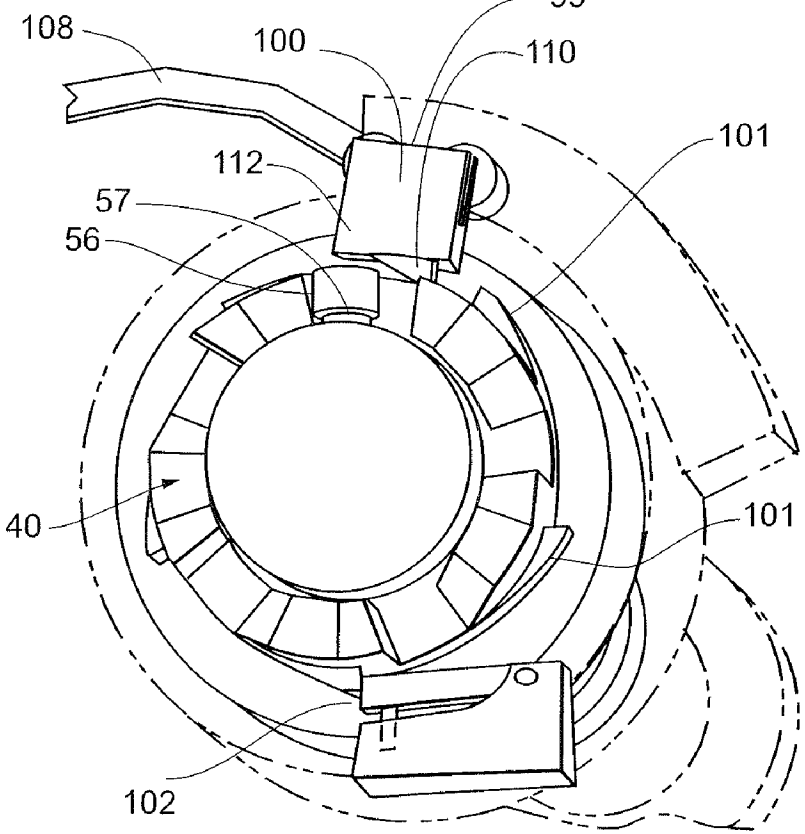
FIG. 5 is a perspective view of the firing pin and valve assembly with the cam latched.
Figure 4:
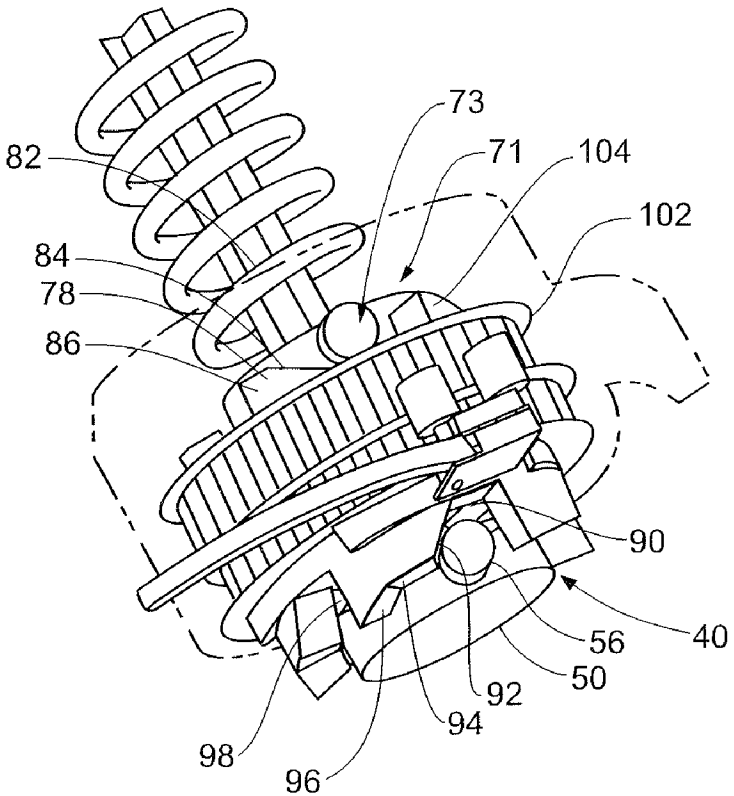
FIG. 4 is a perspective view of the firing pin and valve assembly.

Referring to FIGS. 4 and 5, a roller 56 is operably coupled to the circumferential outer margin of the actuation end 50 of the firing pin 41. The roller 56 is rotatably mounted on a spindle 57. The spindle 57 is fixedly coupled to the actuation end 50 of the firing pin assembly 40.

The second of the major subcomponents of the firing pin and valve assembly 10 is the valve assembly 42. The valve assembly 42 includes a valve 58 having a valve end 60, as best depicted in FIGS. 2 and 3. The valve end 60 expands outward circumferentially from the shank 64. A seat 62 is defined on a rearward directed inclined conical surface of the valve end 60. The valve assembly 42 has an axial bore 66 defined therein. The firing pin assembly is translatably carried within the axial bore 66. Accordingly, the longitudinal axes of the firing pin assembly 40 and the valve assembly 42 are concentric.

A spring seat 68 is radially disposed outward of the shank 64. The spring seat 68 comprises a forward facing transverse shoulder. A fixed spring seat 70 is comprised of a shoulder defined on the rear face of a valve guide 69. The valve guide 69 in part supports the shank 64 of the valve assembly 42. A valve spring 72 is held in compressive engagement with the spring seat 68 and the fixed spring seat 70. The valve spring 72 tends to bias the valve assembly 42 in a rearward direction in a closed (sealed) disposition.

Like the firing pin assembly 40, the valve assembly 42 includes a roller 73 that is rotatably mounted on a spindle 71. The spindle 71 is fixedly coupled to the shank 64 proximate the spring seat 68.

The third subcomponent of the firing pin and valve assembly 10 is the cam assembly 43. The cam assembly 43 generally is a two-faced unitary cam with a forward facing cam face for actuation of the valve assembly 42 and a rearward facing cam face for actuation of the firing pin assembly 40. This is described in greater detail below.

The cam assembly 43 includes the unitary cam 74. The cam 74 is rotatably supported in bearings 76. The forward facing cam face is the valve cam face 78 and the rearward facing cam face is the firing pin cam face 80.

The valve cam face 78 has a valve closed flat 82. A ramp 84 extends from the valve closed flat 82 to the valve open flat 86. A closing transverse face 88 defines the transition between the valve open flat 86 and the valve closed flat 82.

The firing pin cam face 80 includes a firing flat 90 that is connected by a radially outward directed ramp 92 to a cocked flat 94. A short firing ramp 96 extends between the cocked flat 94 and a firing transverse face 98. The firing transverse face 98 extends radially inward to the firing flat 90.

The above described sequence of surfaces for both the valve cam face 78 and the firing pin cam face 80 are sequentially repeated a plurality of times (preferably 4-7 times) around the circumference of the cam 74. Accordingly, the cam 74 need rotate through an arc of between only about 30 and 45 degrees in order to go through a full sequence of both the surfaces on the valve cam face 78 and on the firing pin cam face 80. It is understood that the surfaces on the two faces 78, 80 are timed to provide the desired cooperative motion of both the valve assembly 42 and the cam assembly 43 in order to safely effect a firing sequence.

The cam 74 must be rotated relative to the firing pin assembly 40 and the valve assembly 42 in order to affect the firing sequence. It is understood that both the firing pin 41 and the valve 58 are constrained from rotating, but are free to translate axially. To effect the translations and locking of the firing pin 41 and the valve 58, an actuator assembly 99 includes an actuator 100 and a latch 102. The actuator 100 is designed to selectively engage a tooth 101 projecting outwardly from the circumferential outer margin of the cam 74. A single tooth 101 is associated with each of the series of surfaces defined on the valve cam face 78 and firing pin cam face 80 for effecting a single firing sequence of the firing pin 41 and the valve 58.

Figure 6:
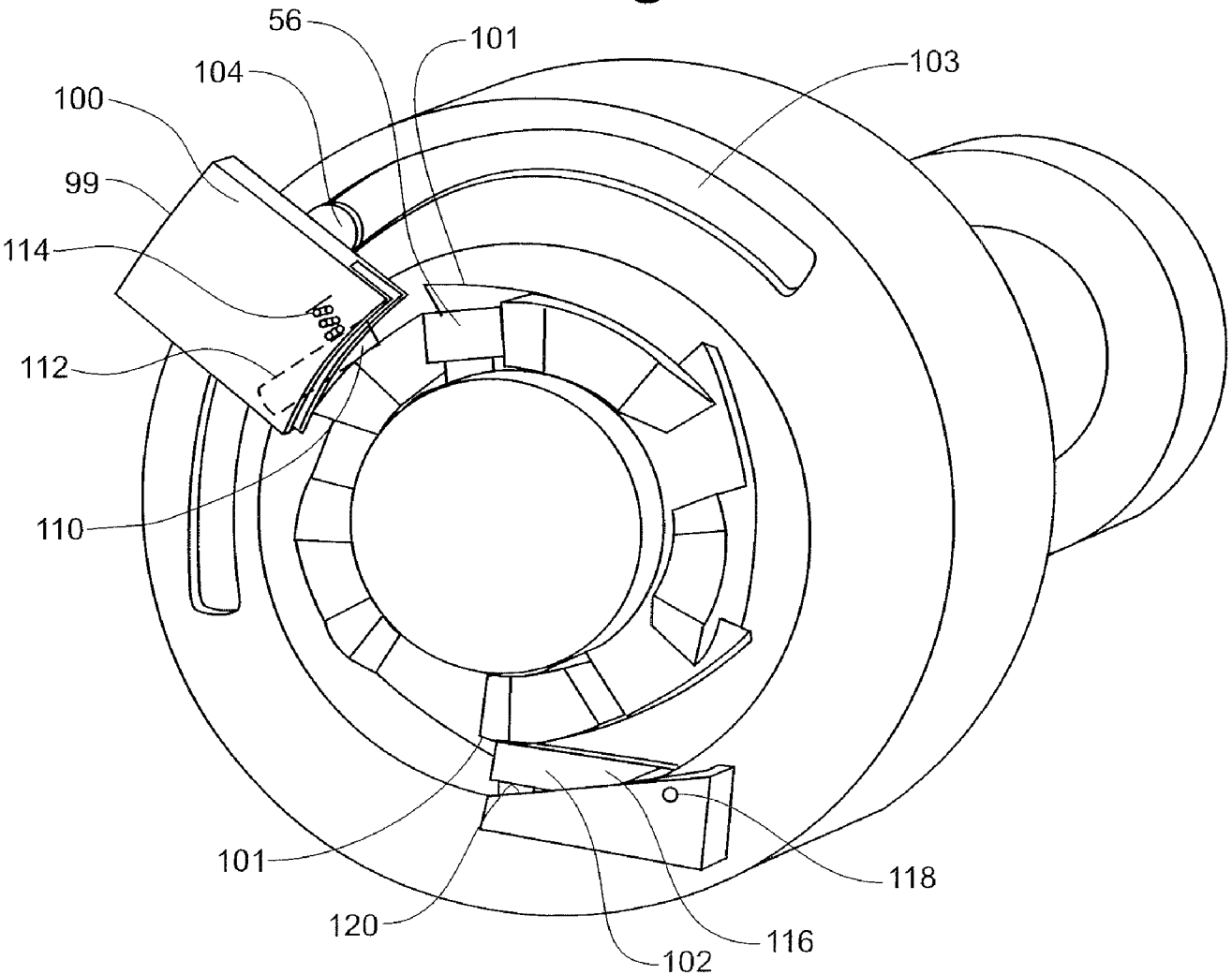
FIG. 6 is a perspective view of the firing pin and valve assemblies with the cam latched.
Figure 7:
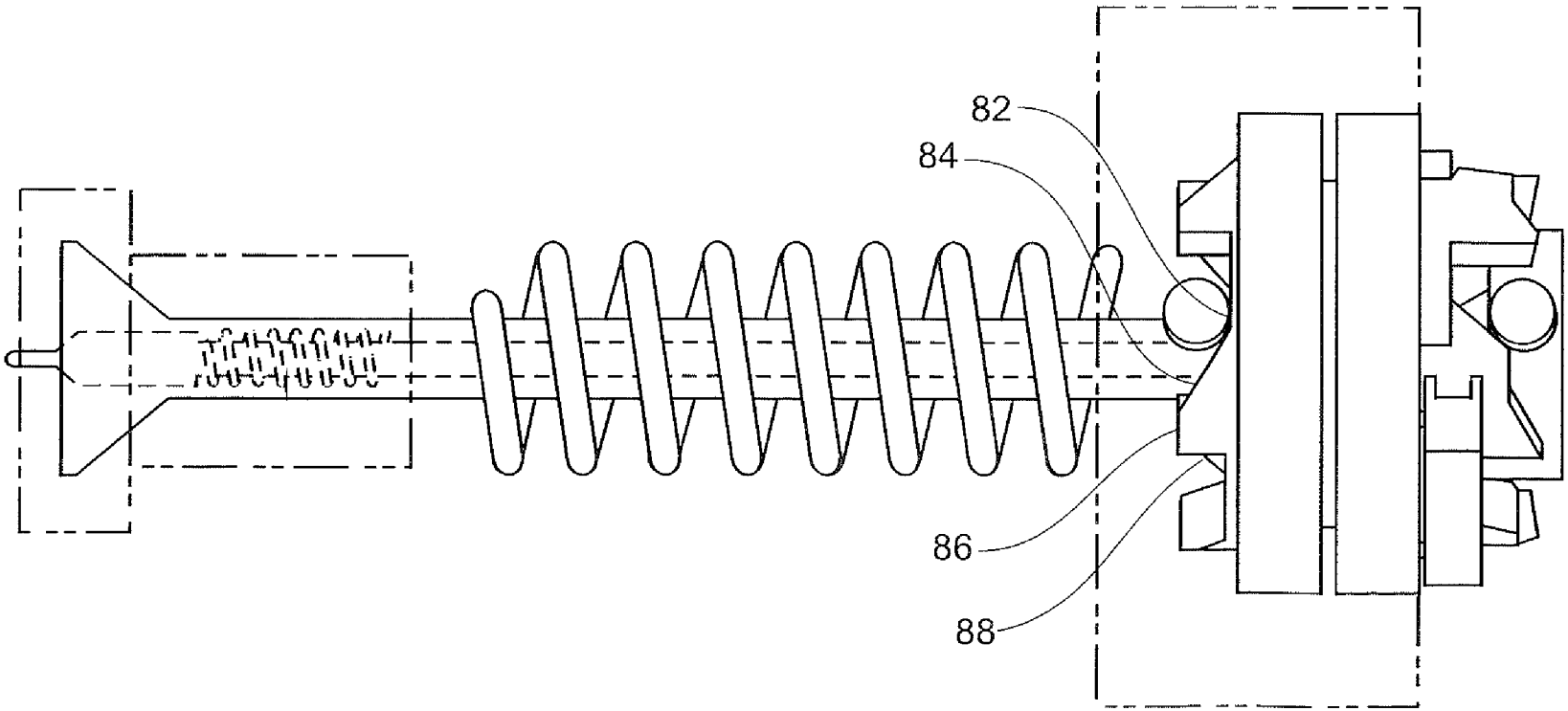
FIG. 7 is a side elevational view of the firing pin and valve assembly.

An actuator guide 103, comprising a semi-circular groove, is defined in the rear margin of the carrier 24. A roller 104, rotably mounted on a spindle affixed to the rear margin of the actuator 100, rides in the actuator guide 103, as depicted in FIG. 6. An actuator arm 108, as depicted in FIG. 5, drives the latch 102 through its arcuate motion.

The actuator 100 includes a pawl 110 for engaging the respective teeth 101. The pawl 110 is rotationally hinged at hinge 112. A spring 114 forces the pawl 110 outward and into contact with the circumferential surface of the cam 74.

The latch 102 is disposed generally diametrically opposed to the actuator 100. The latch 102 includes a latch arm 116 that is designed to engage a tooth 101 and is so positioned as to maintain the roller 56 of the firing pin assembly 40 securely locked on the cocked flat 94 in the cocked disposition of the firing pin 41. This to prevent inadvertent firing as described in greater detail below. The latch arm 116 is hinged at a hinge 118 and is forced into contact with the circumference of the cam 74 by a spring 120.

In operation, two potential problems were sought to be avoided. The first of the two problems was inadvertent firings, alluded to above. In order to ensure that such firings do not occur, the firing pin 41 is retracted to the cocked disposition by rotating the cam 74 such that the roller 56 translates from the firing flat 90, up the ramp 92, and onto the cocked flat 94. In this disposition, the firing pin 41 is retracted and cocked and latched (locked) into place by means of the latch 102 engaging a tooth 101. It should be noted that in this disposition, the roller 73 of the valve assembly 42 is positioned midway up the ramp 84. In such disposition, the valve spring 72 is exerting a counterclockwise (reactive) rotational force on the cam 74 that tends to hold the latch 102 in engagement with the tooth 101. Accordingly, the cam 74 effectively "locks out" the firing pin 41 so that the firing pin 41 is released from the cocked disposition only when desired.

The second problem to be avoided is the potential for the cam assembly 43 to have positional faults. To avoid this problem, the ramped cam surfaces, ramp 84, ramp 92, and firing ramp 96 create a continuous force counteractive (counterclockwise) to the actuator 100. This allows the actuator 100 to overshoot positionally, yet ensures that the cam 74 returns to its desired disposition with the latch 102 holding the cam 74, firing pin 41, and valve 58 in that disposition. This is accomplished by ensuring that the timing of the various surfaces of the cam 74 is such that one or the other of the rollers 56 and 73 is always on a ramped surface when either the firing pin 41 or the valve 58 is residing on a surface other than the valve closed flat 82 or the firing flat 90, respectively. In such disposition, either the firing pin spring 54 or the valve spring 72 is exerting a counterclockwise (reactive) moment on the cam 74, countering the clockwise moment applied by the actuator 100 to the cam 74.

Turning to the operation of the firing pin and valve assembly 10, the basic operating sequence for repeat firing is as follows:

retract the firing pin 41 and lock into place in the cocked disposition;

open the breech, load ammunition, and close the breech;

open the valve 58 with vacuum (negative pressure) applied in order to retract the round;

close the valve;

fire the gun immediately after closing the valve 58 (while the vacuum holds the round retracted).

Optionally, a step can be inserted between the first and second steps of the sequence noted above in which the valve 58 is opened and a positive pressure is applied to it in order to evacuate the gun tube 122 by forcing the round 126 out the muzzle of the gun tube 122. This optional step is taken in the event of a misfire or dud in order to safely clear the gun tube 122 before inserting another rimless round 126.

The aforementioned sequence is treated in greater detail below. To commence the sequence, the actuator arm 108 applies a rotational motion to the actuator 100. The roller 104 rides in the groove 106 giving the actuator 100 an arcuate motion.

As the actuator 100 rotates in the clockwise direction, the pawl 110 engages the first tooth 101 in the path of the actuator 100. As noted above, while the firing pin 41 and valve 58 are translatable longitudinally, the firing pin 41 and valve 58 are rotationally constrained. Accordingly, the cam 74 is free to rotate relative to both the firing pin 41 and valve 58 to effect axial translation of both the firing pin 41 and the valve 58.

After engaging the tooth 101, the actuator 100 commences to rotate the cam 74 in a clockwise direction. The timing of the two cam faces 78, 80 is such that the rotation of the actuator 100 first causes the roller 56 to ride up the ramp 92. Before the roller 56 transitions from the ramp 92 to the cocked flat 94, the roller 73 commences riding up the ramp 84. The translation of the roller 56 to cocked flat 94 the firing flat 90 withdraws the firing pin 41 longitudinally rearward. Once the roller 56 is on the cocked flat 94, the reactive force exerted upon the cam 74 by the valve spring 72 acting on the roller 73 that is residing on the ramp 84 causes the tooth 101 to remain engaged with the actuator 100, locking the pawl 110 in engagement. The latch 102 then holds the cam in this disposition against the reactive force exerted by the valve spring 72 by engaging an oppositely disposed tooth 101. This disposition is with the firing pin 41 fully retracted into the cocked disposition. In such disposition, the breech assembly 12 may be opened and a round 126 loaded.

Further, clockwise rotation of the actuator 100 causes the roller 72 to transition from the ramp 84 to the valve open flat 86 in which the valve 58 is fully opened. At this point in time, the roller 56 has transitioned from the cocked flat 94 to the firing ramp 96 and the firing pin spring 54 is now exerting a reactive force on the cam 74. In this disposition, the vacuum is applied through the open valve 58 to the gun tube 122, pulling the rimless round 126 rearward against left face of the mortar seat 22.

Further rotation of the cam 74 (initiated by a firing command) causes the roller 73 to drop off the valve open flat 86, rapidly passing radially inward under the influence of the expanding valve spring 72 to the closing transverse face 88 to rapidly close and seal the valve 58 by translating the valve 58 rearward. Immediately thereafter and while a vacuum is still being applied to the rimless round 126, the roller 56 drops off the firing ramp 84 and rapidly transitions radially inward along side the firing transverse face 98 to the firing flat 90 under influence of the expanding firing pin spring 54. Such action causes the firing pin 41 to translate rapidly forward as dictated by the bias of the firing pin spring 54. The tip 44 emerges from the mortar seat 22 and strikes the primer 132 of the rimless round 126 to fire the rimless round 126.

A second embodiment of the firing pin and valve assembly of the present invention is shown generally at 210 in FIG. 8-16. In the second embodiment, the actions of the firing pin and valve are essentially similar to that described above. A significant difference is that actuation of the firing pin and valve is performed linearly, as distinct from the rotational actuation effected by the cam 74 above.

A number of components are ancillary to the firing pin and valve assembly 210. Such components include the mortar seat 222. The mortar seat 222 includes a valve seat 224 defined on an inclined conical surface. A rearward directed sleeve 226 functions in part as a housing for the firing pin and valve assembly 210. The sleeve 226 has a relatively large axial bore 228 that extends the full length of the mortar seat 222 for housing the firing pin and valve assembly 210.

An exhaust passageway 229 extends rearward from the forward-most face of the mortar seat 222 to an outward directed exhaust opening. A shoulder 230 proximate the exhaust opening functions as a spring seat.

The rear margin 232 of the mortar seat 222 is captured within a collar 234 affixed thereto. The collar 234 captures the rear margin 232 within a groove 236.

The collar 234 includes a recessed firing pin retainer 238. The firing pin retainer 238 has a rearward directed opening 240. The relatively small bore 242 is defined in the forward margin of the firing pin retainer 238.

A generally rectangular actuator slot 246 extends through the collar 234. The actuator slot 246 is disposed offset from the center of the collar 234.

The firing pin and valve assembly 210 of the second embodiment of the present invention has three major subcomponents: firing pin assembly 250, valve assembly 252, and actuator assembly 254.

The firing pin assembly 250 includes a leftward directed tip 260 designed to impact the primer 132 of a rimless round 126. Extending rearward from the tip 260 is a relatively small diameter shank 262. A first portion of the shank 262 expands in diameter to form a first shoulder 264. A rounded transition 266 extends from the first shoulder 264 to the second shoulder 268. A plurality of balls 270 are disposed circumferential to and radially translatable with respect the first shoulder 264. The rearward face of the second shoulder 268 defines a transverse firing pin spring seat 272.

The actuation end 274 of the firing pin assembly 250 has an expanded diameter shoulder 276 that is translatably disposed within the firing pin retainer 238. The rear most portion of the shank 262 passes through the bore 242 defined in the firing pin retainer 238.

A firing pin spring 278 is captured between the transverse firing pin spring seat 272 and a guide 280. The left most face of the guide 280 comprises a firing pin spring seat 284. A guide bore 282 defined axially through the guide 280 translatably supports a portion of the shank 262. The rearmost portion of the guide 280 extends radially outward to define a shoulder 285. The forward margin of the shoulder 285 defines a valve spring seat 286.

The second subcomponent of the firing pin and valve assembly 210 is the valve assembly 252. The valve assembly 252 includes a valve 288 having a valve head 289 coupled to a shank 290. The shank 290 is of relatively generous diameter so that the firing pin bore 292 defined with the shank 290 can accommodate substantial portions of the firing pin assembly 50. The firing pin bore 292 accommodates the greater diameter portions of the firing pin assembly 250. A firing pin bore extension 294 extends forward from the firing pin bore 292 and is of significantly smaller diameter. The firing pin bore extension 294 translatably supports a portion of the shank 262 of the firing pin 258. The shoulder 295 defines the transition between the firing pin bore 292 and the firing pin bore extension 294.

A ball slot 296 is defined in the shank 290 adjacent each of the balls 270. The ball slot 296 accommodates radial translation of a respective ball 270 therethrough.

A valve seat 298 is defined on the inner inclined margin of the valve head 289. The valve seat 298 sealingly abuts the valve seat 224 when the valve 288 is in the closed disposition.

A valve spring 300 is disposed concentric with the shank 290 and is captured at a first end by the valve spring seat 286 of the guide 280.

The final subcomponent of the firing pin and valve assembly 210 is the actuator assembly 254. The actuator assembly 254 includes a linear actuator 302 and a sleeve 304. The linear actuator 302 has a clevis 306 that is translatably borne within the actuator slot 246. A transverse bore 307 is defined through the clevis 306. An actuation means (not shown) may engage the transverse bore 307 for linear actuation of the linear actuator 302.

The clevis 306 is fixedly coupled to a collar 308. The collar 308 is generally cylindrical in shape. The clevis 306 is coupled thereto offset from the center line of the collar 308. The collar 308 includes a radially outward directed shoulder 307. An axial bore 311 is defined in the collar 308 for passage of the firing pin shank 262 therethrough. The linear actuator 302 is fixedly coupled to the sleeve 304 at the rearward margin of the sleeve 304. The sleeve 304 has an axial bore 310 defined therethrough that has a generous diameter for translatably carrying the shank 290 of the valve assembly 252. The sleeve 304 includes a ball groove 312 proximate its forward margin. The ball groove 312 is deep enough to accommodate a hemisphere of the respective balls 270.

An internal shoulder defined within the axial bore 310 defines a valve spring seat 314. The valve spring 300 is compressively captured between the seat 298 and valve spring seat 314.

The sleeve 304 includes a second spring seat defined proximate its forward margin comprising the actuator spring seat 316. The actuator spring seat 316 is defined by a shoulder in the exterior margin of the sleeve 304. The actuator spring seat 316 compressively captures the actuator spring 318 between the actuator seat 316 and the shoulder 230 defined in the mortar seat 222.

Figure 8:
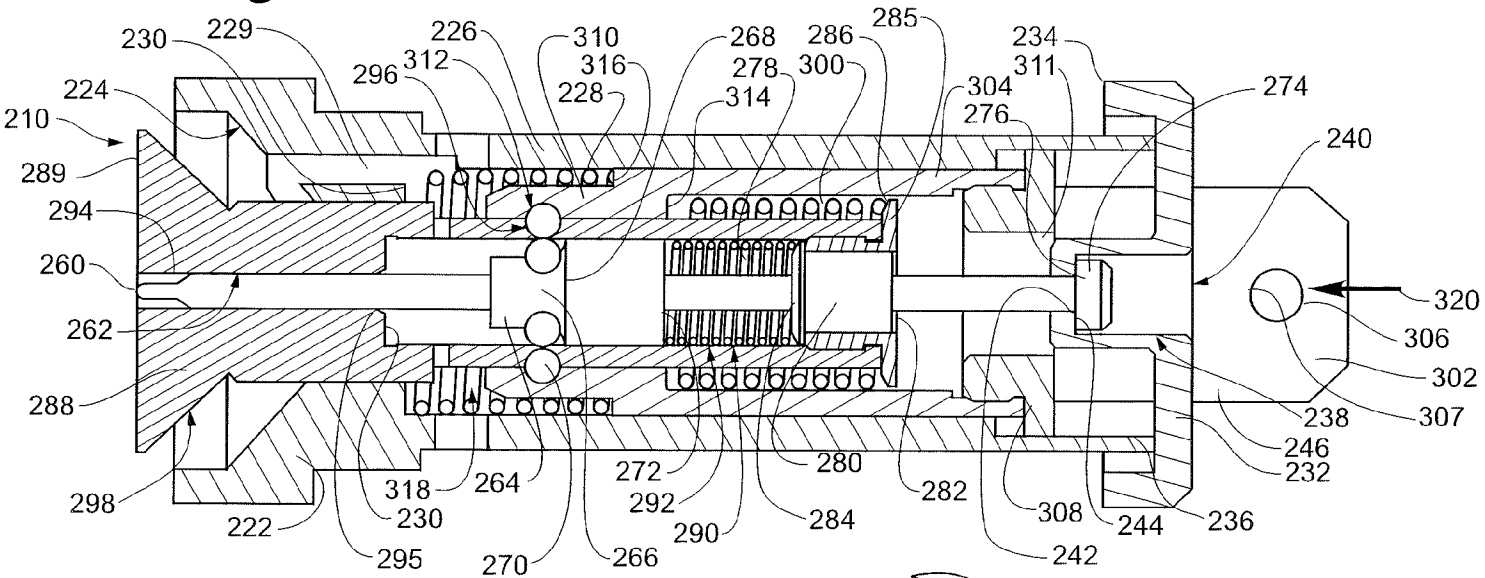
FIG. 8 is a longitudinally sectioned elevational view of a second embodiment of the present invention.
Figure 9:
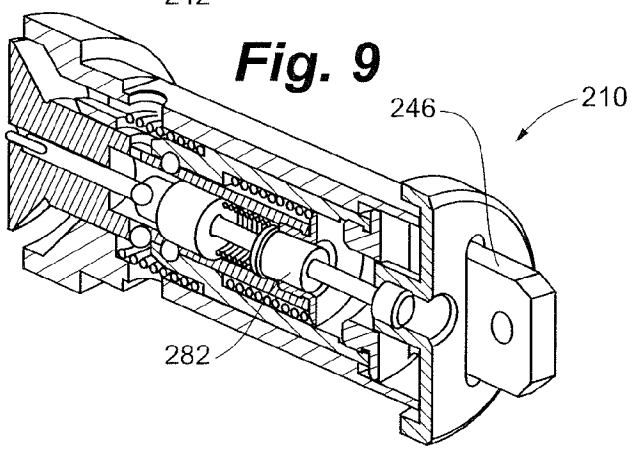
FIG. 9 is a sectioned perspective view of the invention of FIG. 8.

Operation of the firing pin and valve assembly 210 of the second embodiment of the present invention can be viewed by stepping sequentially through the FIGS. 8-16, commencing with FIGS. 8 and 9. The first action is open valve 288/reset. It should be noted that the reset action may be automatically effected by the act of opening of the breech of the gun. In this step, the actuation sleeve 304 and the linear actuator 302 move forward as indicated by arrow 320 to the extended position. The balls 270 move into an over/travel position. The firing pin 258 is held in position with the shoulder 276 of the actuation end 274 in engagement with the shoulder 244 of the collar 234. The balls 270 clear the firing pin 258 and unlock the valve 288.

Figure 10:
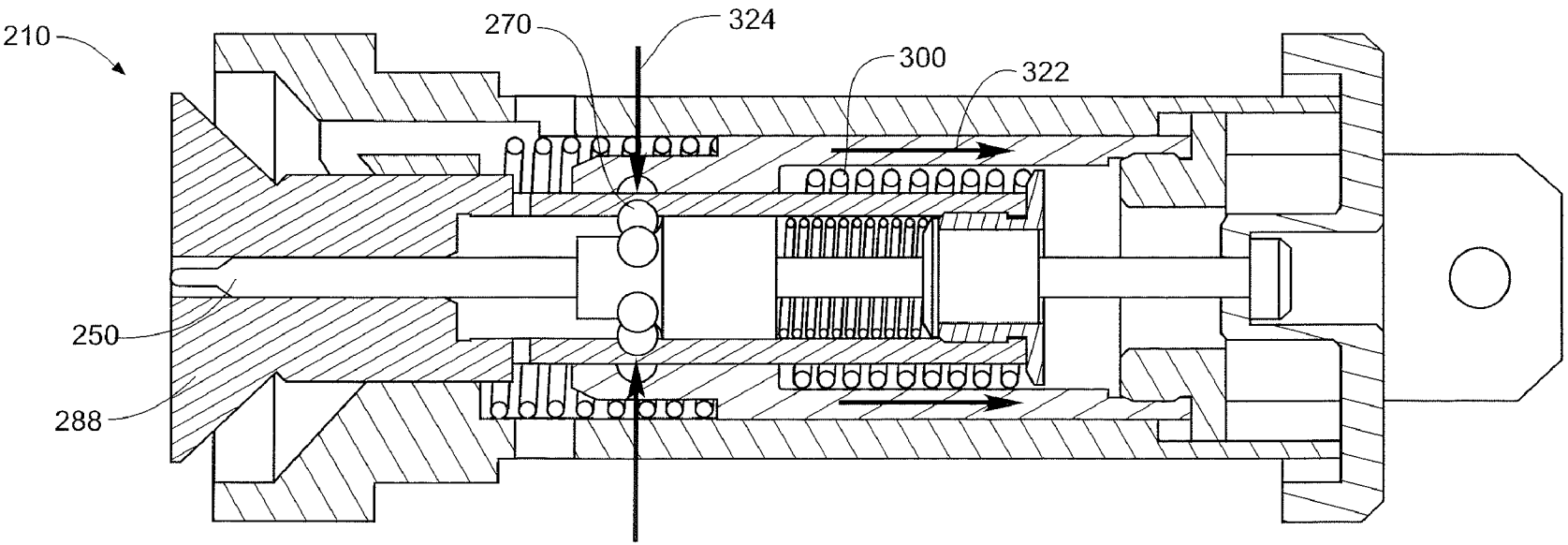
FIG. 10 is a longitudinally sectioned elevational view of a second embodiment with the firing pin captured.

The second action in the sequence is firing pin 258 capture, as depicted in FIG. 10. The valve spring 300 biases the valve 288 rearward as indicated by arrow 322. The balls 270 are driven radially inward as indicated by the arrows 324 to capture the firing pin 258.

Figure 11:
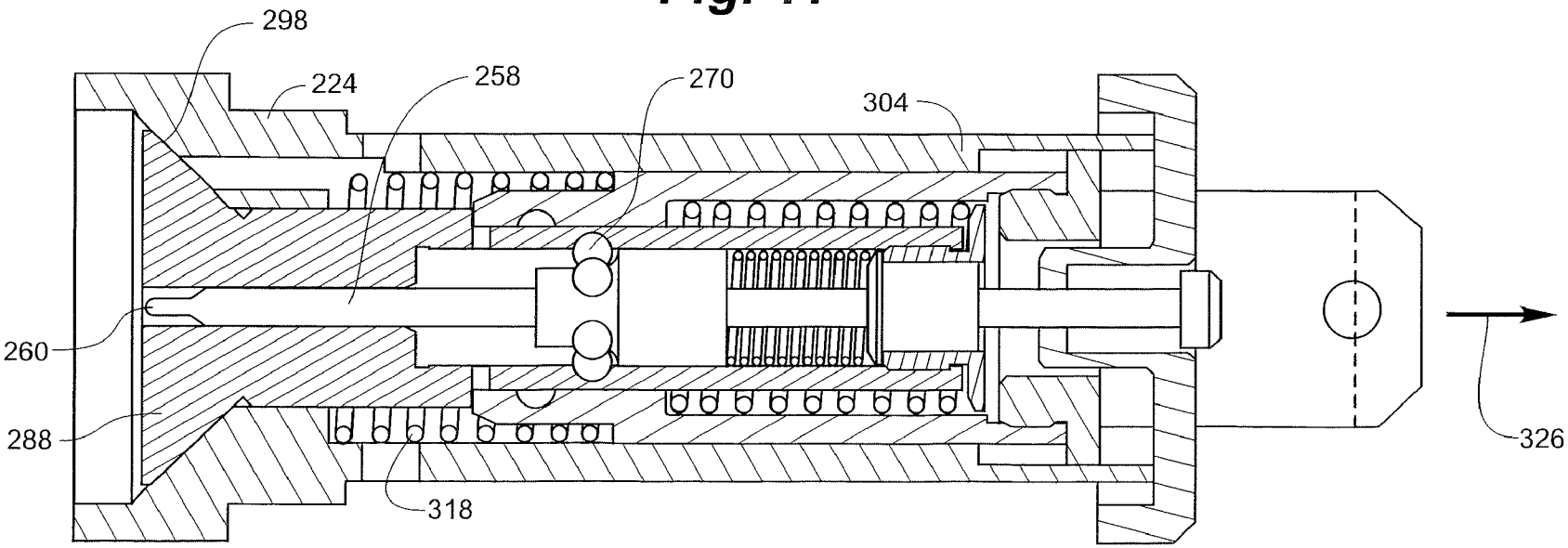
FIG. 11 is a longitudinally sectioned elevational view of a second embodiment in the neutral disposition.

The third action is depicted in FIG. 11. This action is return to the neutral position. The actuator assembly 259 is translated rearward as indicated by the arrow 326. The valve 288 is closed and sealed with the seat 298 being in engagement with the valve seat 224. The actuator spring 318 holds the valve 288 closed. The firing pin 258 is clear in the cocked position with the tip 260 withdrawn into the valve assembly 252. The balls 270 are locked inward in engagement with the firing pin 258 by the inner margin of the sleeve 304, thereby locking the firing pin 258 in the cocked disposition. In this disposition, a round 126 may be loaded into the gun tube 122 and the breech assembly 12 closed.

Figure 12:
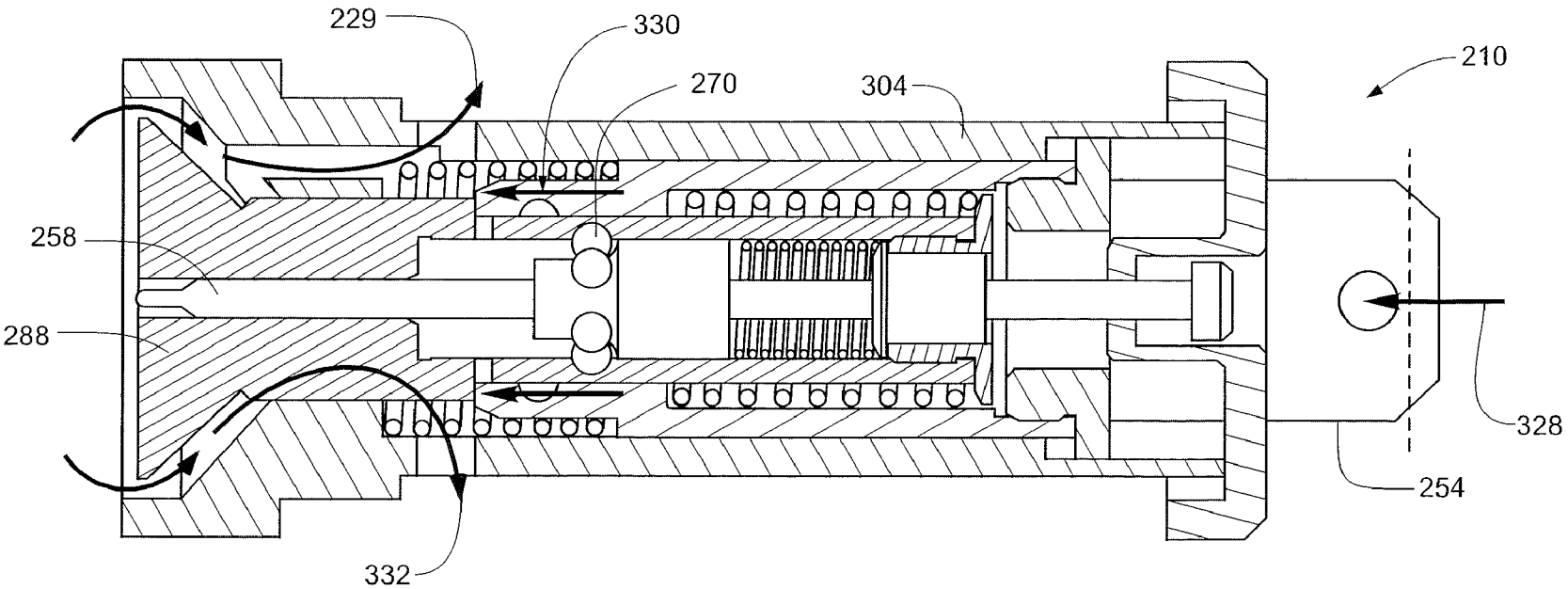
FIG. 12 is a longitudinally sectioned elevational view of a second embodiment with the valve open.

The fourth action in the sequence is depicted in FIG. 12 and is the valve 288 at open. The actuator assembly 254 is translated forward, as depicted by arrow 328. The actuator assembly 254 pushes the valve 288 forward, unseating the valve 288 as depicted by the arrows 330. The firing pin 58 remains in the cocked disposition, the balls 270 being locked by the inner margin of the actuation sleeve 304. A vacuum is drawn through the exhaust passage 229 in the breech portion of the gun tube 122 momentarily evacuating the gun tube 122 and drawing the projectile 126 rearward to seat the projectile 126 for firing, as indicated by the arrows 332.

Figure 13:
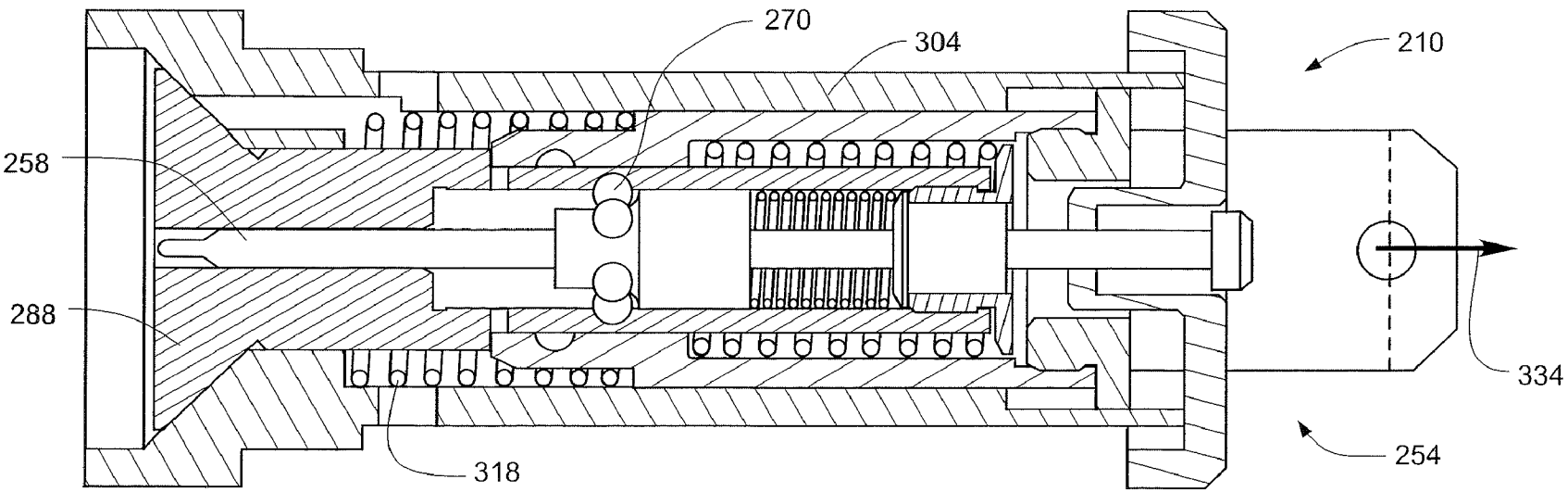
FIG. 13 is a longitudinally sectioned elevational view of a second embodiment with the valve closed.

Close valve is the fifth action of the sequence, depicted in FIG. 13. The actuator assembly 254 is translated rearward as indicated by the arrow 334. The valve 288 is then in the seated closed disposition. The actuator spring 318 holds the valve 288 as the actuation sleeve 304 moves through a neutral position. The firing pin 258 remains in the cocked position. The balls 270 remain locked by the inner margin of the actuation sleeve 304.

Figure 14:
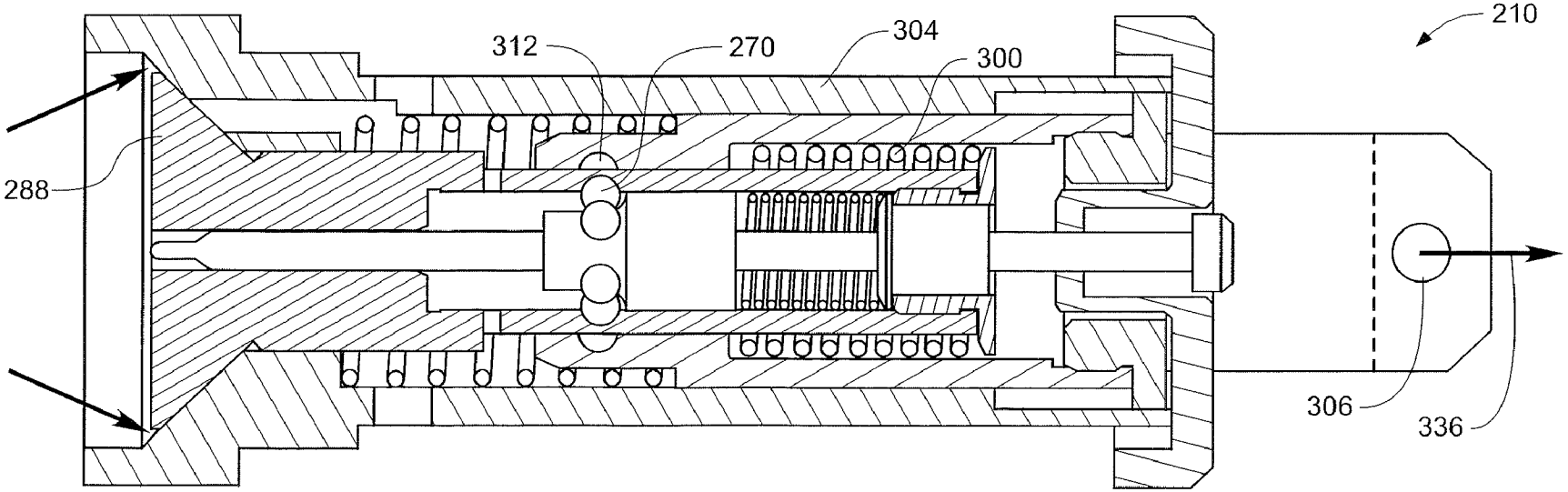
FIG. 14 is a longitudinally sectioned elevational view of a second embodiment with the sleeve retracted.

FIG. 14 depicts the sixth action in the operational sequence, retract sleeve. The clevis 306 is pulled further rearward as indicated by arrow 336 to initiate firing. The sleeve 304 compresses the valve spring 300. The valve 288 is held in the closed disposition. The sleeve ball groove 312 reaches alignment with the balls 270. It should be noted that actions 4-6 can be a single motion.

Figure 15:
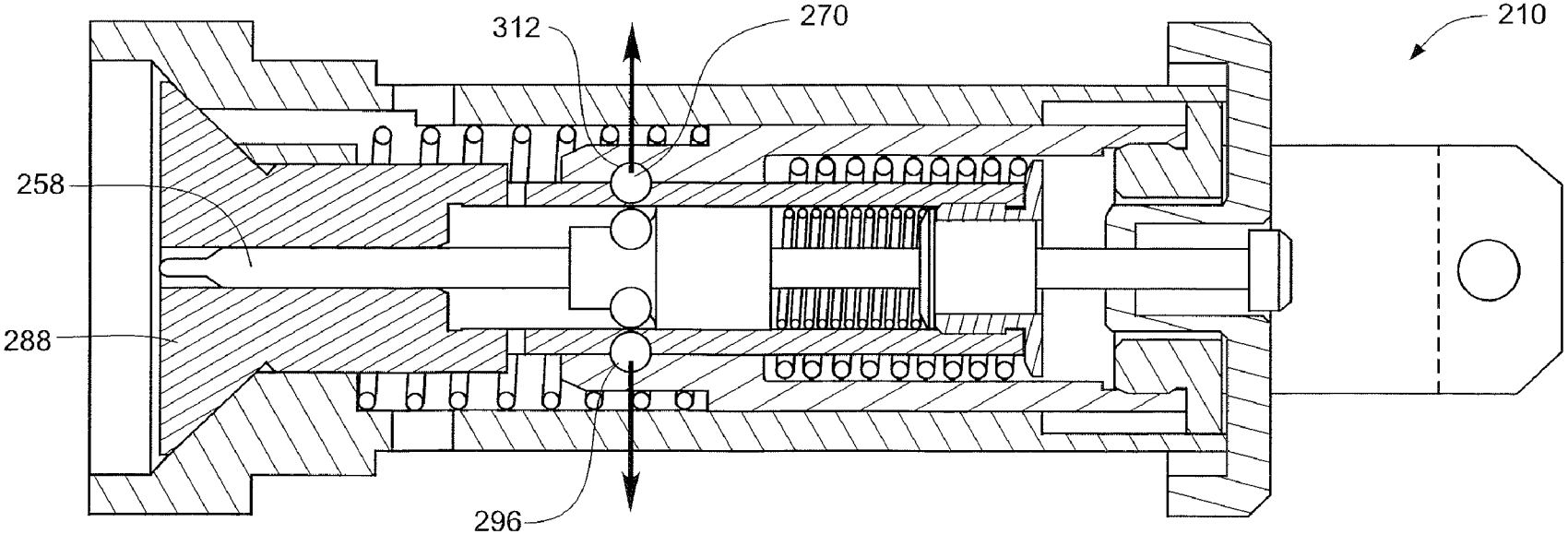
FIG. 15 is a longitudinally sectioned elevational view of a second embodiment with the firing pin released (fired)

Firing pin release is the seventh action in the sequence and is depicted in FIG. 15. Forward motion of the firing pin 58 forces the balls 270 radially outward through the ball slot 296 defined in the valve 288 and into the ball groove 312 defined in the sleeve 304, locking the balls 270 into the ball groove 312.

Figure 16:
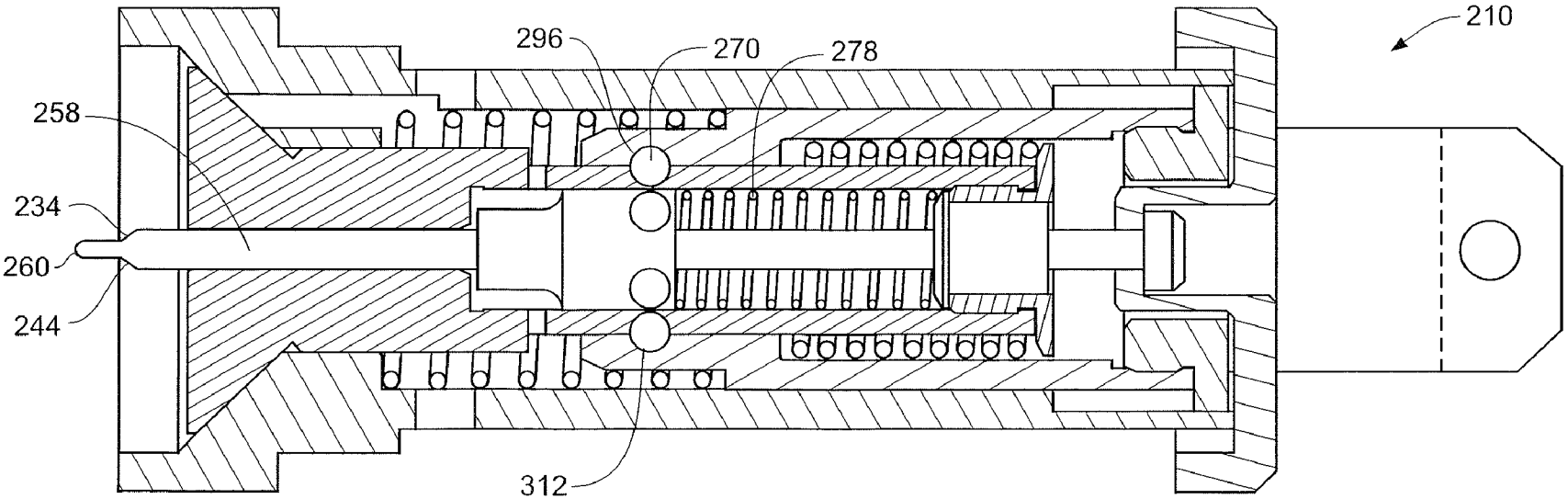
FIG. 16 is a longitudinally sectioned elevational view of a second embodiment with the firing pin in the contact disposition.
Figure 17:
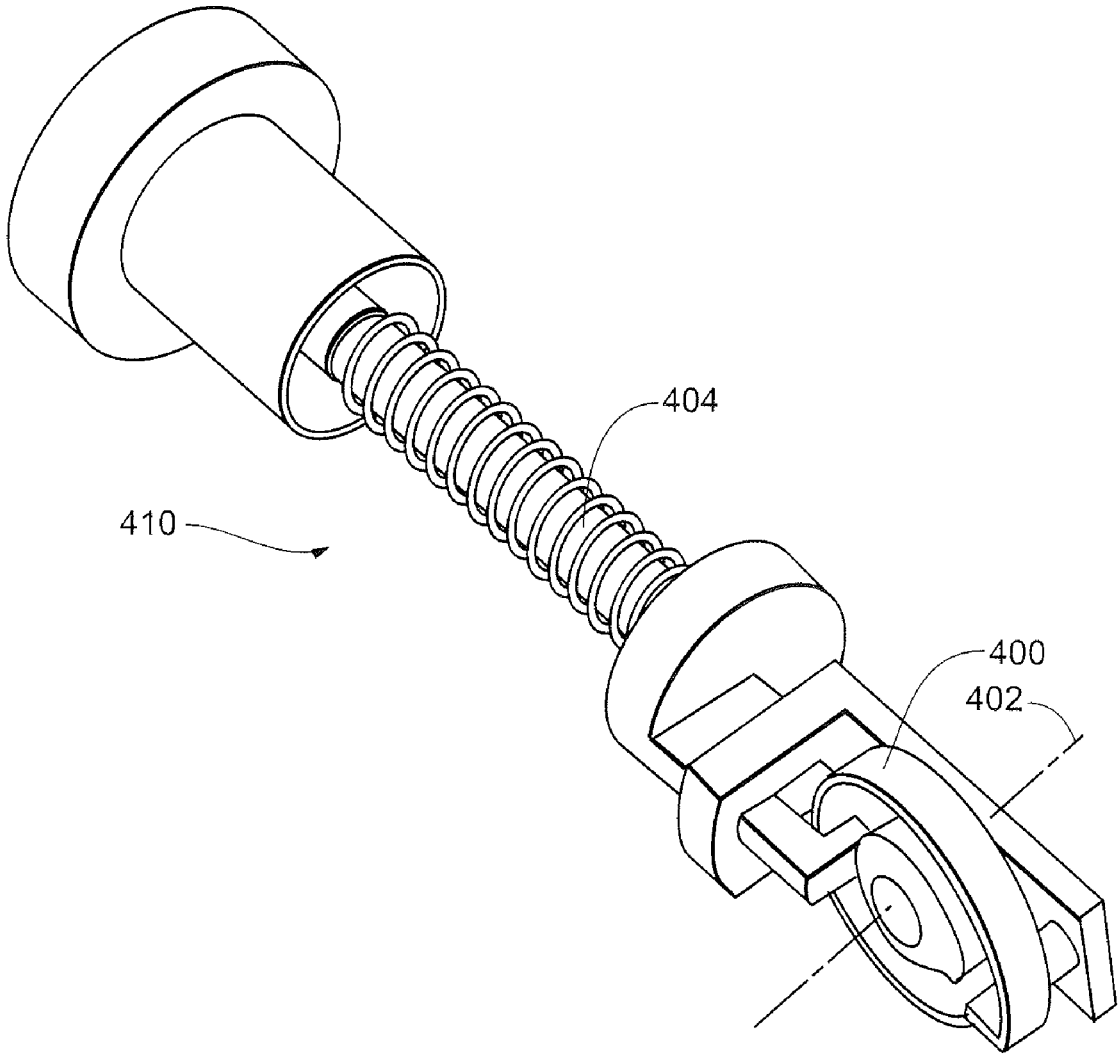
FIG. 17 is a perspective view of a third embodiment with cam actuation acting linearly.
Figure 18:
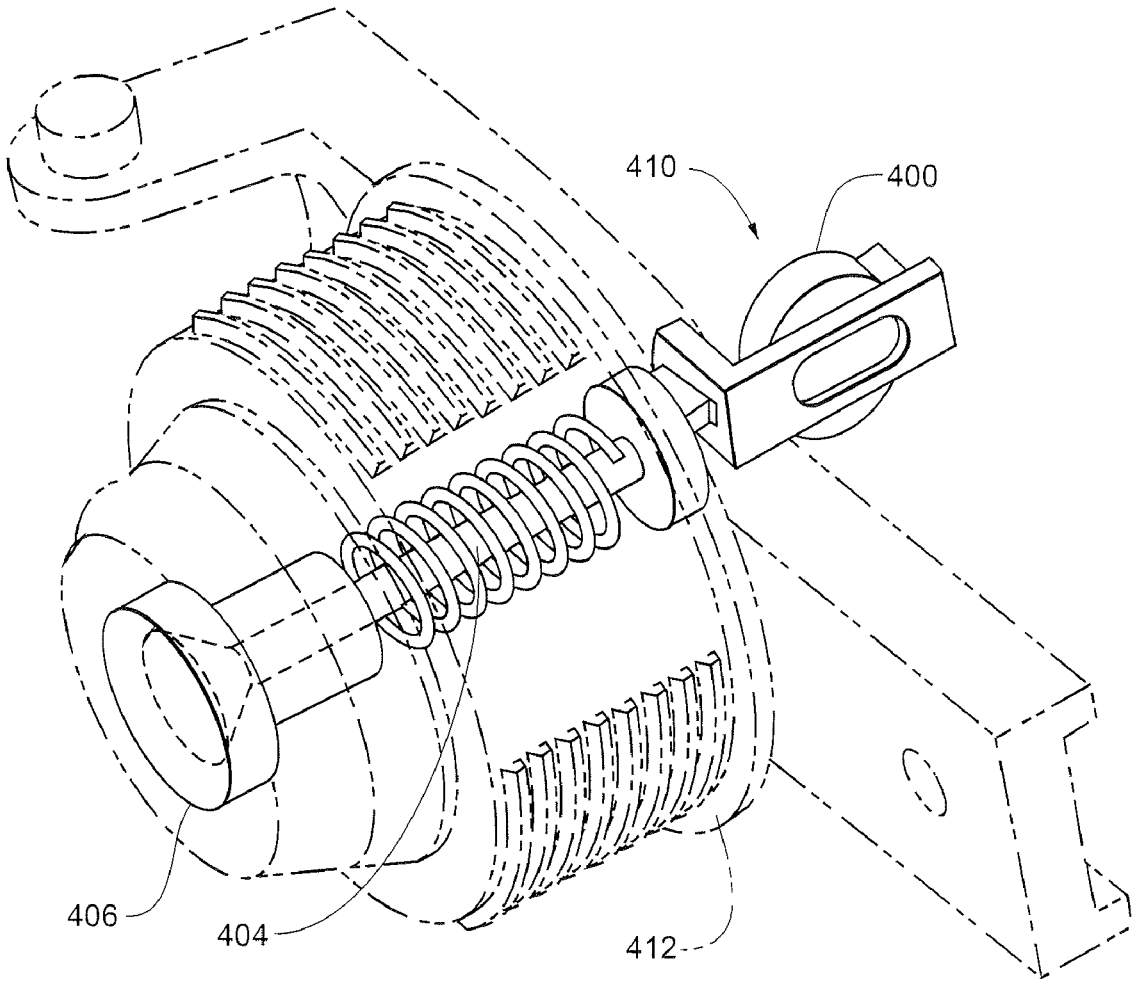
FIG. 18 is a perspective view of the third embodiment with the firing pin and valve assembly integrated into a breech assembly.

The final action in the sequence of operation is the eighth action depicted in FIG. 16, firing pin contact. The firing pin 258 clears the balls 270, residing in the ball slot 296 and the ball groove 312. The firing pin spring 278 drives the firing pin 258 forward for the tip 60 of the firing pin 258 to contact the primer of the round. The round is fired. Forward motion of the firing pin 258 is stopped by the shoulder 276 contacting the shoulder 244 of the collar 234. FIGS. 17 and 18 depict a third embodiment of the present invention. The firing pin and valve assembly 410 is cam actuated in as manner similar to the cam 74 above. The axis of rotation of the cam 74 is coaxial with the longitudinal axis of the firing pin 58. In distinction, the cam 400 of the third embodiment has an axis or rotation 402 that is transverse to the longitudinal axis of the firing pin 404. Actuation of the firing pin 404 and valve 406 remains in directions that are coaxial with the longitudinal axis of the firing pin 404. FIG. 18 depicts the firing pin and valve assembly 410 integrated in a breech assembly 412.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A gun for firing a round of caseless ammunition, a round of such ammunition having a projectile and a modular propellant, the gun comprising a gun tube, a breech housing and an in barrel air regulation system, the breech housing including a breech and a firing pin and valve assembly, said breech readily removable from the breech housing for loading the round into the gun tube, wherein the firing pin and valve assembly includes a valve, a firing pin assembly and an actuator assembly, the valve being mechanically actuated for introducing through the breech a pressure differential in the gun tube through the in barrel air regulation system, and wherein the firing pin assembly includes a latch and an actuator operably connected to a firing pin, the firing pin is maintained in a locked position through the latch until release by a fire control command.

2. The gun of claim 1, both the firing pin and valve being actuatable through a known sequence of dispositions wherein actuation of both the firing pin and valve is always against an opposing bias, the bias tending to return both the firing pin and the valve to their respective previous disposition in the sequence.

3. The gun of claim 1, the actuatable valve being selectively openable to the gun tube, the valve for imposing a positive pressure in the gun tube, the positive pressure acting to eject the round from the gun tube.

4. The gun of claim 1, actuation of the valve and the firing pin being mechanically linked.

5. The gun of claim 2, timing of the firing pin and valve actuation being such that when the firing pin is in a disposition of the sequence of dispositions, the valve is in transition between two dispositions of the sequence of dispositions.

6. The gun of claim 5, the valve exerting a restraining bias on motion of the firing pin when the valve is in transition between two dispositions of the sequence of dispositions.

7. A firing pin and valve assembly for use in a gun having a breech assembly, the gun for firing a round of caseless ammunition, a round of such ammunition having a projectile and a modular propellant, the projectile and a modular propellant being loaded into the breech assembly for firing in a gun tube, the firing pin and valve assembly comprising:

an actuatable valve being selectively openable to the gun tube said valve connected to an in barrel air regulation system that includes a pump at the opposing end for drawing a negative pressure in the gun tube, the negative pressure acting to pull the round into contact with a breech face;

a firing pin positioned within the breech assembly so as to reliably strike a primer of the modular propellant, and a cam assembly, said cam assembly is a two-face unitary cam with a firing pin cam path and an actuatable valve cam path, said firing pin and actuatable valve arranged coaxially to the cam assembly.

8. The firing pin and valve assembly of claim 7, both the firing pin and valve being actuatable through a known sequence of dispositions wherein actuation of both the firing pin and valve is always against an opposing bias, the bias tending to return both the firing pin and the valve to their respective previous disposition in the sequence.

9. The firing pin and valve assembly of claim 7 including an actuator assembly preventing forcible release of the firing pin, said actuator assembly including an actuator, a latch and a tooth, the tooth projecting outward from the circumferential outer margin of the cam, the actuator selectively engages the tooth through the latch so that the firing pin is locked in a cocked position.

10. The firing pin and valve assembly of claim 9, the actuatable valve being alternatively selectively openable to the gun tube while the firing pin is in a cocked position, the valve operably connected to the pump for imposing a positive pressure in the gun tube, the positive pressure acting to eject the round from the gun tube.

11. The firing pin and valve assembly of claim 7, actuation of the valve and the firing pin being mechanically linked.

12. The firing pin and valve assembly of claim 8, timing of the firing pin and valve actuation being such that when the firing pin is in a disposition of the sequence of dispositions, the valve is in transition between two dispositions of the sequence of dispositions.

13. The firing pin and valve assembly of claim 12, the valve exerting a restraining bias on motion of the firing pin when the valve is in transition between two dispositions of the sequence of dispositions.

14. A method of operating a gun for firing a round of caseless ammunition, a round of such ammunition having a projectile and a modular propellant, the projectile and a modular propellant being disposable for firing in a gun tube, the gun tube including a breech assembly at a first end and a muzzle at the second end, the method comprising:

loading the round into the gun tube through the breech assembly;

actuating a valve in the breech assembly to draw a negative pressure in the gun tube and pull the round into contact with a breech face of the breech assembly;

closing the valve upon commanding the gun to fire;

releasing a firing pin wherein the firing pin and the valve are actuated from a common two faced cam, the firing pin reliably strikes a primer of the modular propellant, the primer igniting the modular propellant, the ignited propellant forcefully discharging the projectile from the gun tube.

15. The method of claim 14, including actuating both the firing pin and valve through a known sequence of dispositions, imparting an opposing bias against the actuation of both the firing pin and valve, and tending to return both the firing pin and the valve to their respective previous disposition in the sequence by means of the opposing bias.

16. The method of claim 14 including effecting the actuation of both the valve and the firing pin such that the valve is always closed momentarily before the firing pin is released to strike the primer.

17. The method of claim 14, alternatively selectively opening the actuatable valve to the gun tube and imposing a positive pressure in the gun tube, the positive pressure acting to eject the round from the gun tube.

* * * * *